United States Patent [19]

Cordani et al.

[11] 4,422,532

[45] Dec. 27, 1983

[54] HAND BRAKE MECHANISM INCLUDING FORCE DIVIDING ASSEMBLY

[75] Inventors: Eugene J. Cordani, Florissant; James C. Hammonds, St. Charles; Frederick E. Vorwerk, St. Peters, all of Mo.

[73] Assignee: ACF Industries, Incorporated, New York, N.Y.

[21] Appl. No.: 272,599

[22] Filed: Jun. 11, 1981

[51] Int. Cl.[3] ..... B61H 13/00

[52] U.S. Cl. ..... 188/47; 188/52

[58] Field of Search ..... 188/47, 52–55, 188/107, 193, 204 R, 6 R, 46, 219.1, 202, 190, 207, 212, 213, 217, 106 F; 105/406 R, 4 R

[56] References Cited

U.S. PATENT DOCUMENTS

| | | | |
|---|---|---|---|
| 1,177,618 | 4/1916 | Gregg | 188/47 |
| 4,091,742 | 5/1978 | Cordani | 105/406 R |
| 4,315,465 | 2/1982 | Cordani et al. | 105/4 R |

*Primary Examiner*—Douglas C. Butler

*Attorney, Agent, or Firm*—Henry W. Cummings

[57] ABSTRACT

A railroad car (12) has a set (B1) of brakes acting on wheels (W1) at one end of the car and a set (B2) of brakes acting on wheels (W2) at the opposite end of the car. A mechanism (38) for applying a brake force produced by operation of a hand brake (HB) includes a force splitter (40) interconnected with the hand brake and one set (B1) of wheels to transmit the brake force to this set of brakes. A first torque unit (54) is interconnected with the force splitter to transfer the brake force from one end of the car to the other. A second torque unit (74) is interconnected with the first torque unit and the other set (B2) of brakes to transmit the brake force to this other set of brakes. Application of both sets of brakes in response to operation of the hand brake prevents movement of the car.

24 Claims, 6 Drawing Figures

HAND BRAKE MECHANISM INCLUDING FORCE DIVIDING ASSEMBLY

BACKGROUND OF THE INVENTION

This invention relates to railroad car hand brake mechanisms and more particularly to a mechanism for applying a hand brake force to sets of brakes acting on wheels at opposite ends of a railroad car to prevent movement of the car.

U.S. Pat. No. 4,091,742, issued May 30, 1978 describes a stacked container well hole gondola car. Further, U.S. patent application Ser. No. 153,470 filed May 27, 1980, now U.S. Pat. No. 4,315,465 issued Feb. 16, 1982, discloses a series of such cars wherein adjoining ends of adjacent cars are supported on a common truck. The car described in the patent has a first set of brakes acting on wheels at one end of the car and a second set of brakes acting on wheels at the other end of the car. For the series of cars described in the application, a first set of brakes acts on wheels at the outer end of the car while a second set of brakes acts on wheels mounted on the common truck at the other end of the car. In each instance, the first set of brakes acts on wheels located on one side of the railroad car while the second set of brakes acts on wheels located on the opposite side of the car. This is done to prevent inadvertent setting of brakes which could occur if, for example, both sets of brakes were located on the same side of the car and it went around a curb sharp enough so foreshortening of the brake linkages caused the brake pads to contact the wheels. Since the sets of brakes are located on opposite sides of the car, it is necessary to transfer the brake application force produced by operation of a hand brake typically located at one end of the car not only to the set of brakes located at that end of the car but also to the other end of the car and transversely across the car. A major problem in accomplishing this for the cars described in the aforementioned patent and patent application is that the cars described therein have depressed center sections which preclude a simple or conventional linkage arrangement of the types found on other types of railroad cars.

SUMMARY OF THE INVENTION

Among the several objects of the present invention may be noted the provision of a mechanism for applying a brake force to the sets of brakes at each end of a railroad car, the force being produced by operation of a hand brake; the provision of such a mechanism for transferring the force from one end of the railroad car to the other and for transmitting the force across the centerline of the car at the other end of the car so the force is transmitted to sets of brakes located on opposite sides of the car; the provision of such a mechanism for applying a brake force sufficient to meet Association of American Railroads (AAR) standards; the provision of such a mechanism which is also useful with a series of railroad cars employing common trucks where one of the sets of brakes acts on wheels carried by the common truck; and the provision of a second mechanism identical to the first for use with a series of three or more cars employing common trucks with one mechanism serving to transmit a brake force to the sets of brakes at one end of the series of cars and the second mechanism serving to transmit a brake force to similarly arranged sets of brakes at the other end of the series of cars.

Briefly, the present invention is for a mechanism for applying a brake force to sets of brakes located at opposite ends of a railroad car, particularly a car having a depressed center section. The mechanism includes a force splitter interconnected with a hand brake located at one end of the car and with a first set of brakes acting on a first set of truck mounted wheels at that end of the car. The force splitter transmits a brake force produced by operation of the hand brake to the first set of wheels. A first torque means is interconnected with the force splitter for transferring the brake force produced by operation of the hand brake from the one end of the car to the other. A second torque means is interconnected with the first torque means and with a second set of truck mounted wheels at the other end of the car to transmit the brake force to this second set of brakes. The brake force is thus applied to the sets of brakes at both ends of the car to prevent movement of the car. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figures 1, 3, 4, 5:
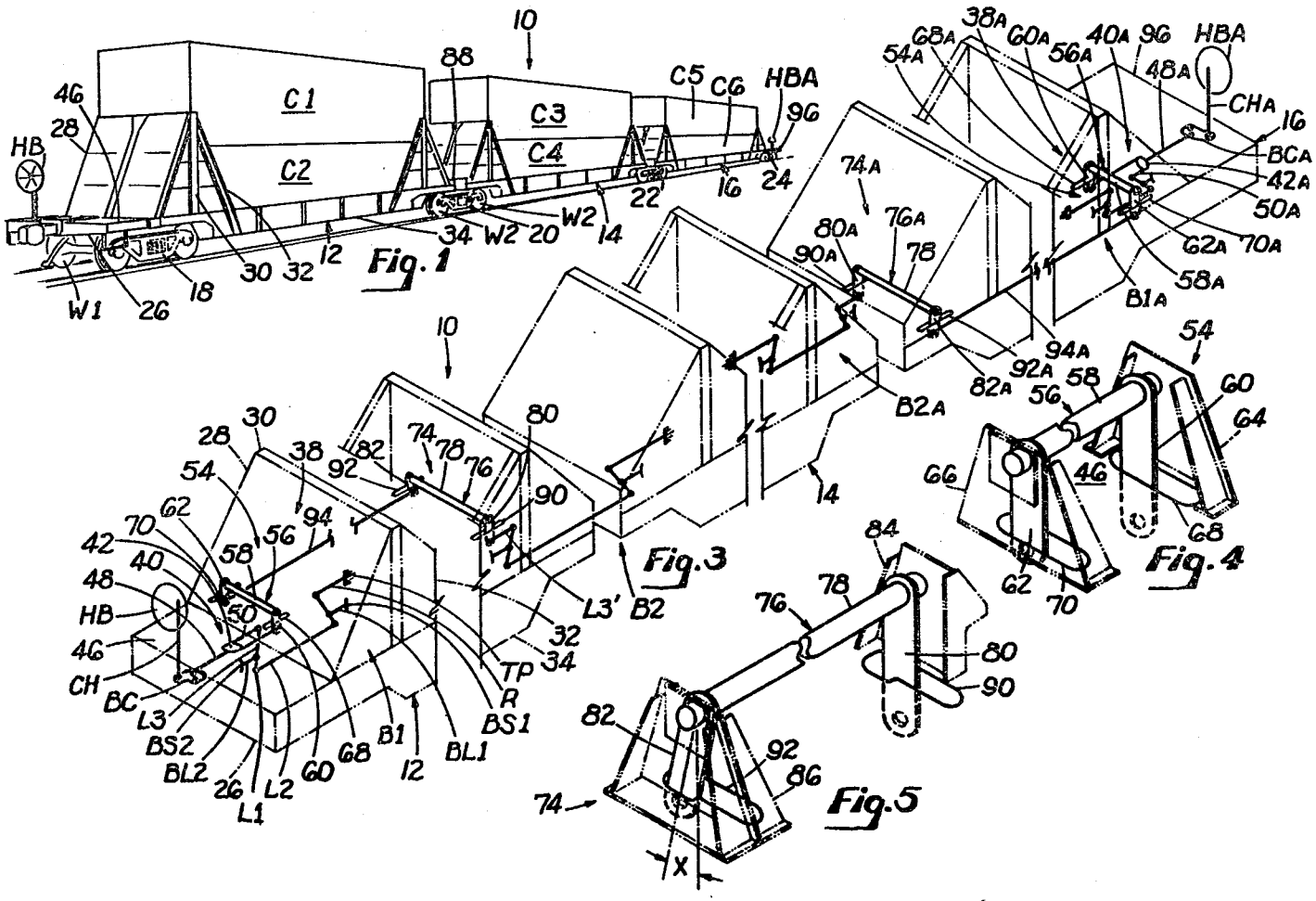
FIG. 1 is a perspective view of a series of stacked container railroad cars having depressed center sections.
FIG. 3 is a schematic representation of the apparatus of the present invention.
FIG. 4 is a perspective view of a first bell crank comprising a portion of the mechanism of the present invention.
FIG. 5 is a perspective view of a second bell crank comprising another portion of the mechanism of the present invention.

Referring to the drawings, a series of interconnected railroad cars are indicated generally 10 in FIGS. 1 and 3. The series of cars includes car bodies 12, 14, and 16 supported upon trucks 18, 20, 22 and 24. Car bodies 12, 14 and 16 are each constructed in accordance with the teachings of U.S. Pat. No. 4,091,742 issued May 30, 1978. The cars are therefore stacked container cars having a depressed center section. As shown in FIG. 1, car 12 has an end sill 26 located above truck 18 and includes an end diagonal 28 extending upwardly to an end bulkhead 30. A pair of stacked containers C1 and C2 are held in place on car 12 partly by bulkhead 30 and partly by a diagonal 32 extending forwardly from end bulkhead 30 to a side sill 34. It will be understood that the remaining construction details of car 12 are similar to those above set forth and in accordance with the teachings of U.S. Pat. No. 4,091,742. Further, cars 14 and 16 are similar in construction to car 12. This car 14 holds in place a pair of stacked containers C3 and C4 and car 16 holds in place a pair of stacked containers C5 and C6.

Truck 18 at the outer end of car 12 and truck 24 at the outer end of car 16 are conventional trucks of the type well known in the art. The inner end of car 12 and the adjacent end of adjoining car 14 are commonly supported by truck 20 which may, for example, be of the type described in U.S. patent application Ser. No. 153,470 filed May 27, 1980. Truck 22 which commonly supports the inner end of car 16 and the adjacent end of adjoining car 14 is similar in construction to truck 20.

Figure 2:
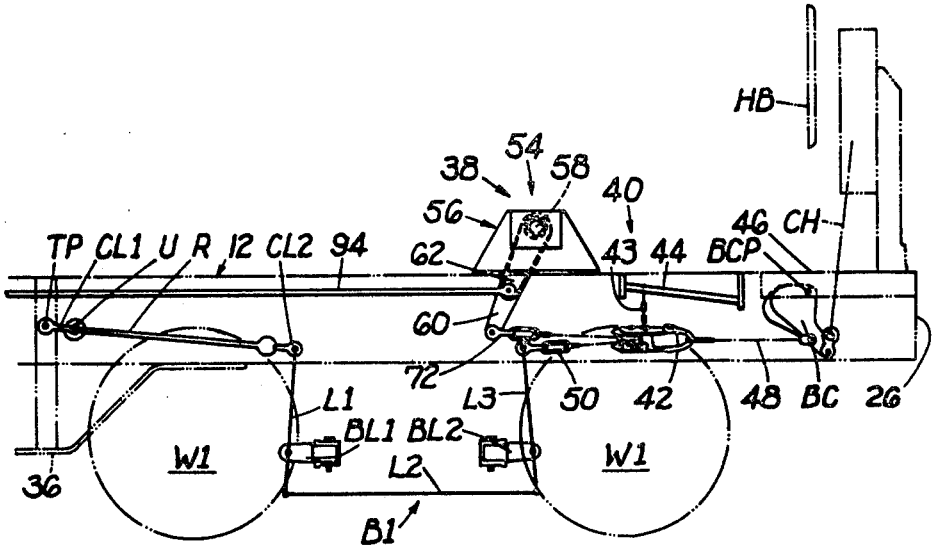
FIG. 2 is a side elevational view of a portion of the mechanism of the present invention for applying a brake force to a set of brakes at one end of a railroad can before application of the hand brake.

Car 12 has a first set of brakes indicated generally B1 in FIGS. 2 and 3, this set of brakes being applied to a pair of wheels W1 mounted on truck 18. These wheels are on the far side of car 12 as viewed in FIG. 1. A second set of brakes indicated generally B2 are applied to a pair of wheels W2 mounted on truck 20. This second set of brakes is on the opposite side of car 12 from set B1 and are applied to the wheels W2 shown on the near side of car 12 as viewed in FIG. 1. Referring to FIG. 2, brake set B1 includes a pair of brake lever BL1 and BL2 to which brake shoes BS1 and BS2 (see FIG. 3) are attached. The brake levers are positioned to apply the respective brake shoes to the inside portion of the rims of wheels W1.

A compressed air line (not shown) extending the length of a train including car series 10 is used to apply the brakes to the wheels in the conventional manner well known in the art. The brakes however may be manually applied and for this purpose a hand brake HB is mounted on end sill 26 of car 12. A clevis CL1 is pivotally attached to a tie point TP on the inside of a side sill 36 of car 12. A rod R is connected to clevis CL1 via a universal type joint connection U. The other end of rod R is attached to a clevis CL2. One end of a link L1 is also connected to clevis CL2 and extends through brake level BL1. The other end of link L1 is pivotally connected to a horizontal link L2 which extends from one wheel W1 to the other. The other end of this link is pivotally attached to a third link L3 which extends upwardly through brake lever BL2. Hand brake HB is manually operable to rotate a bell crank BC about its pivot pin BCP from its solid line position shown in FIG. 2 counterclockwise to the position of the bell crank shown in FIG. 6. This is accomplished via a chain CH as is conventional in the art. Movement of bell crank BC serves to apply a brake force produced by operation of hand brake HB to the set of links whereby the links L1, L2 and L3 and the brake levers BL1 and BL2 are moved from their position shown in FIG. 2 to their positions shown in FIG. 6. This results in application of brake shoes BS1 and BS2 to the set of wheels W1. Set B2 of brakes at the other end and on the opposite side of car 12 is similar in construction to the set B1 just described.

The present invention comprises a mechanism indicated generally 38 for applying a brake force produced by operation of hand brake HB to both sets B1 and B2 of brakes so both sets of brakes are applied to their respective sets of wheels to prevent movement of car 12 or series 10 of cars. Mechanism 38 includes a force splitting means 40 interconnected with hand brake HB and set B1 of brakes for transmitting a brake force produced by operation of the hand brake to brake set B1. As shown in FIG. 2, means 40 includes a sheave 42 suspended by a chain 43 from a hanger 44 positioned beneath the floor 46 of end sill 26. Sheave 42 is attached to bell crank BC via a chain 48. Hanger 44 extends laterally and generally parallel to the center line of car 12 and slopes rearwardly thus to facilitate rearward movement of sheave 42 when bell crank BC is rotated counterclockwise by operation of hand brake HB. A second chain 50 extends through sheave 42. One end of chain 50 is connected to the upper end of link L3 via a clevis 52.

Mechanism 38 next includes a first torque means 54 interconnected with sheave 42 for transferring the brake force produced by operation of hand brake HB to the other end (the inner end) of car 12. As shown in FIGS. 2, 3 and 4, first torque means 54 includes a bell crank 56 comprising a torque tube 58 extending transversely to center line of car 12, a first lever arm 60 attached to one end (the inner end) of the torque tube and a second lever arm 62 attached to the other end (the outer end) of the torque tube. The ends of torque tube 58 are journalled for rotation in a pair of brackets 64 and 66 welded or otherwise secured to the upper surface of end sill floor 46. A slot 68 is cut in floor 46 adjacent bracket 64 and first lever arm 60 of bell crank 56 extends beneath the floor through this slot. A similar slot 70 is cut in floor 46 adjacent bracket 66 and second lever arm 62 extends beneath the floor through this slot. Both slots are sufficiently long so as not to interfere with the movements of the lever arms. As best shown in FIG. 2, lever arms 60 and 62 are parallel to and in registry with each other. In addition, lever arm 62 is somewhat shorter than lever arm 60. Lever arm 60 is attached to the opposite end of chain 50 from link L3 by a clevis 72. As a result, rearward movement of sheave 42 upon operation of hand brake HB produces a counterclockwise rotation of bell crank 56.

Mechanism 38 further includes a second torque means 74 (FIG. 3) interconnected with first torque means 54 and set B2 of brakes for transmitting the brake force produced by operation of hand brake HB to this second set of brakes. As shown in FIGS. 3 and 5, second torque means 74 includes a bell crank 76 comprising a torque tube 78 extending transversely to the center line of car 12, a first lever arm 80 attached to one end (the inner end) of the torque tube, and a second lever arm 82 attached to the other end (the other end) of the torque tube. The outer ends of torque tube 78 are journalled for rotation in a pair of brackets 84 and 86 which are secured to the upper surface of the floor of end sill 88 at the inner end of car 12. A slot 90 is cut in the sill 88 floor adjacent bracket 84 and first lever arm 80 extends beneath the floor through this slot. A slot 92 is cut in the sill 88 floor adjacent bracket 86 and second lever arm 82 extends beneath the floor through this bracket. Again, both slots are sufficiently long so as not to interfere with movement of the lever arms. Lever arms 80 and 82 are parallel to each other and lever arm 82 is preferably rotated a predetermined angle X with respect to lever arm 80. This angle is preferably 10° to 25°, for example, 17°.

As shown in FIG. 3, lever arm 80 is connected to brake set B2 and specifically to the end of a linkage L3' corresponding to link L3 of brake set B1. A rigid rod 94 (see FIGS. 2 and 3) has one end carried by lever arm 62 of bell crank 56 and the other end of the rod is carried by lever arm 82 of bell crank 76. Rod 94 extends the length of car 12 and is positioned outside side sill 36 of the car.

Figure 6:
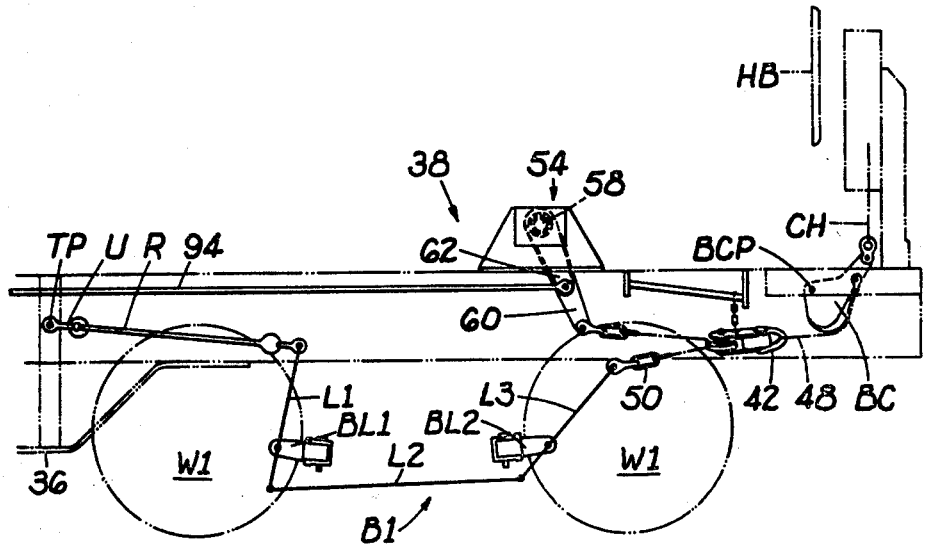
FIG. 6 is a view similar to FIG. 2 but showing the mechanism in the applied position.

In operation, turning hand brake HB in the direction to move bell crank BC counterclockwise results in sheave 42 being pulled rearwardly (to the right) as shown in FIG. 6. This action serves to engage brake set B1 as previously described. At the same time, chain 50 exerts a force on lever arm 60 of bell crank 56 producing counterclockwise rotation of the bell crank. Rod 94 is pulled rearwardly by this movement of lever arm 62 to, in turn, exert a counterclockwise rotative force on lever arm 82 of bell crank 76. The subsequent rotation of bell crank lever arm 80 acts to engage brake set B2 in the same manner brake set B1 is engaged.

With reference to FIG. 3, it will be noted that torque tube 58 does not extend across centerline of car 12 while the length of torque tube 78 is such that it does cross the centerline thus transmitting the brake force from one side of the car to the other. It will be understood that mechanism 38 has similar construction features and functions in a similar manner if car 12 were not part of a series 10 of cars and had a set of truck mounted wheels at its inner end similar to truck 18.

Under present Association of American Railroads (AAR) standards a brake system for series of cars must meet certain requirements. If the series 10 of cars shown in FIGS. 1 and 3 consisted, for example, only of cars 12 and 14, the mechanism 38 would be adequate in that brakes on two out of the three trucks employed could be engaged using hand brake HB. Where, however, series 10 involves three cars such as shown in the drawings, the single hand brake system employing mechanism 38 would be inadequate. To meet AAR standards, a second hand brake system is required capable of engaging two additional sets of brakes such as those designated B1A and B2A in FIG. 3. Set B1A of brakes acts on wheels carried on truck 24 at the outer end of car 16 and set B2A of brakes acts on a set of wheels carried on the common truck 22 supporting adjacent ends of cars 14 and 16. The wheels engaged by brake set B1A are on the opposite side of car 16 from the wheels engaged by brake set B2A. A second hand brake HBA is located on an end sill 96 of car 16. Brake sets B1A and B2A are similar in design and operation to brake sets B1 and B2 and a mechanism 38A similar to mechanism 38 acts to apply the brake force produced by operation of hand brake HBA to brake sets B1A and B2A. Thus mechanism 38A includes a force splitting means 40A comprising a sheave 42A connected to a bell crank BCA by a chain 48A, bell crank BCA being moved by a chain CHA when hand brake HBA is turned in the appropriate direction. Sheave 42A is connected to brake set B1A by one end of a chain 50A the other end of which is attached to a lever arm 60A of a bell crank 56A comprising a first torque means 54A. Bell crank 56A also includes a torque tube 58A and a second lever arm 62A. In addition, mechanism 38A includes a second torque means 74A comprising a bell crank 76A having a torque tube 78A with a lever arm 80A at one end and a lever arm 82A at the other end. Lever arm 82A and lever arm 62A are each attached to an end of a rigid rod 94A for a brake force produced by operation of hand brake HBA to be transferred to the inner end of car 16. Lever arm 80A is connected to a link of brake set B2A to apply the brakes of the set to the wheels mounted on the side of truck 22. As noted, these wheels are on the opposite side of car 16 from the wheels to which the brakes of set B1A are applied. Application of these sets of brakes in addition to the brakes of brake sets B1 and B2 insures adequate braking force to prevent movement of series 10 of cars and this configuration meets present AAR standards.

While one application of the hand brake system of the present invention is to a stacked container car, it will be apparent that the hand brake system is applicable to any railway car having a depressed center section and to railway cars in general.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. Mechanism for applying a brake force to a first set of brakes acting on a first set of wheels at a first end of a railway car and to a second set of brakes acting on a second set of wheels at the other end of the car; the first set of brakes being located on the opposite side of the car from the second set of brakes, and the brake force being produced by a manually operable hand wheel, the mechanism comprising: force splitting means interconnected with the hand brake for transmitting the brake force produced by operation of the hand brake to the first set of brakes; first torque means interconnected with the force splitting means for transferring the brake force produced by operation of the hand brake to the opposite end of the car; and second torque means interconnected with the first torque means for transferring the brake force transversely across the car to the second set of brakes whereby the first and second sets of brakes are applied to their respective sets of wheels to prevent movement of the car.

2. In a series of interconnected railroad cars wherein adjacent ends of adjoining cars are supported by a common truck having an associated set of wheels and the outer end of each end car in the series is also supported by a truck having a set of wheels, a first set of brakes acting on the set of wheels at the outer end of one of the end cars and a second set of brakes acting on the set of wheels carried by the common truck on which the inner end of the end car is supported, and a manually operable hand brake for producing a brake force applied to the first and second sets of brakes, the improvement comprising: a mechanism for applying the brake force to the first and second sets of brakes including force splitting means interconnected with the hand brake and the first set of brakes for transmitting the brake force produced by operation of the hand brake to first set of brakes; first torque means interconnected with the force splitting means for transferring the brake force produced by operation of the hand brake to inner end of the car; and second torque means interconnected with the first torque means and the second set of brakes for transmitting the brake force to the second set of brakes whereby a brake force is applied to the first and second set of brakes sufficient to prevent movement of the series of railroad cars.

3. In a series of interconnected railroad cars including at least three cars with adjacent ends of adjoining cars supported by a common truck having a set of wheels and the outer end of each end car supported by a truck having a set of wheels, a set of brakes acting on the set of wheels at the outer end of each end car, a set of brakes acting on the set of wheels on the common truck at the inner end of each end car, the set of brakes acting on the wheels on the common truck being on the opposite side of the end car from the set of brakes acting on the set of wheels at the outer end of each end car, and a manually operable hand brake located at the outer end of each end car for producing a brake force applied to the set of brakes for the wheels on the truck at the outer end of its associated car and to the set of brakes for the wheels on the common truck at the inner end of its associated car comprising:

a first and a second mechanism for applying the respective brake forces to the respective sets of brakes, each mechanism including respective force splitting means interconnected with a respective hand brake and with the set of brakes acting on the wheels at the outer end of the respective end car for transmitting the brake force produced by operation of the respective hand brake to the respective set of brakes; respective first torque means interconnected with the respective force splitting means for transferring the brake force produced by the respective hand brake to the inner end of its associated end car; and, respective second torque means interconnected with the respective first torque means and with the respective set of brakes for the wheels on the common truck at the inner end of the respective end car to transmit the brake force produced by the respective hand brake to this respective set of brakes whereby a brake force is applied to the sets of brakes for the respective end cars in the series of interconnected cars thereby to prevent movement of the series of cars.

4. Mechanism for applying a brake force to a first set of brakes acting on a first set of wheels located at one end of a railroad car and to a second set of brakes acting on a second set of wheels located at the other end of the car, the brake force being produced by operation of a manually operable hand brake and the mechanism comprising: force splitting means interconnected with the hand brake and the first set of brakes for transmitting the brake force produced by operation of the hand brake to the first set of brakes; first torque means interconnected with the force splitting means for transferring the brake force produced by operation of the hand brake to the opposite end of the car; and second torque means interconnected with the first torque means and the second set of brakes for transmitting the brake force to the second set of brakes.

5. In a railroad car having a depressed center section, a first set of truck mounted wheels located at one end of the car and a second set of truck mounted wheels located at the opposite end thereof, a first and second set of brakes respectively acting on the first and second sets of wheels and a manually operable hand brake producing a brake force applied to the sets of brakes to prevent movement of the car, the improvement comprising: a mechanism for applying the brake force to the brakes including force splitting means interconnected with the hand brake and the first set of brakes for transmitting a brake force produced by operation of the hand brake to the first set of brakes; first torque means interconnected with the force splitting means for transferring the brake force produced by operation of the hand brake to the other end of the car; and, second torque means interconnected with the first torque means and the second set of brakes for transmitting the brake force to the second set of brakes whereby the brake force is applied to both sets of brakes to prevent movement of the car.

6. A railroad car according to claim 5, wherein said center section is adapted to carry at least one container.

7. In a railroad car having a set of truck mounted wheels at each end, a first set of brakes for application to the set of wheels at one end of the car, a second set of brakes for application to the set of wheels at the other end of the car and a hand brake mechanism located at one end of the car for producing a brake force sufficient to apply the first and second set of brakes to the wheels to prevent movement of the car, the improvement comprising: force splitting means interconnected with the hand brake mechanism and the first set of brakes for transmitting a brake force created by operation of the hand brake mechanism to the first set of brakes; first torque means interconnected with the force splitting means for transferring the brake force created by operation of the hand brake mechanism to the opposite end of the car; and second torque means interconnected with the first torque means for transmitting the brake force transferred by the first torque means to the second set of brakes whereby the second set of brakes is applied to its associated set of wheels.

8. Mechanism for applying a brake force to a first set of brakes acting on a first set of wheels at a first end of a railway car and to a second set of brakes acting on a second set of wheels at the other end of the car, the first set of brakes being located on the opposite side of the car from the second set of brakes and the brake force being produced by a manually operable hand wheel, the mechanism comprising: force splitting means interconnected with the hand brake for transmitting the brake force produced by operation of the hand brake to the first set of brakes; first torque means interconnected with the force splitting means for transferring the brake force produced by operation of the hand brake to the opposite end of the car; and second torque means interconnected with the first torque means for transferring the brake force transversely across the car to the second set of brakes whereby the first and second sets of brakes are applied to their respective sets of wheels to prevent movement of the car; said first torque means including a bell crank comprising a torque tube extending transversely to the center line of the car; a first lever arm attached to one end of the torque tube and a second lever arm attached to the other end thereof; the first lever arm being attached to the force splitting means whereby operation of the hand brake produces rotation of the bell crank via the force splitting means.

9. The mechanism of claim 8, wherein the second lever arm of the bell crank is parallel to and in registry with the first lever arm.

10. The mechanism of claim 9, wherein the second lever arm is shorter than the first lever arm.

11. The mechanism of claim 8, wherein the second torque means includes a bell crank comprising a torque tube extending transversely to the center line of the car, a first lever arm attached to the second set of brakes and a second lever arm interconnected with the second lever arm of the bell crank of the first torque means whereby rotation of the bell crank of the first torque means produces a simultaneous rotation of the bell crank of the second torque means.

12. The mechanism of claim 11, further including a rigid rod one end of which is carried by the second lever arm of the bell crank of the first torque means and the other end of which is carried by the second lever arm of the bell crank of the second torque means.

13. The mechanism of claim 11, wherein the first and second lever arms of the bell crank of the second torque means are parallel to each other with the second lever arm rotated a predetermined angle with respect to the first lever arm.

14. The mechanism of claim 13, wherein the second lever arm of the bell crank of the second torque means is shorter than the first lever arm thereof.

15. The mechanism of claim 11, wherein the second set of brakes is located on the opposite side of the car from the first set of brakes, the torque tube of the bell crank of the first torque means being located on the same side of the center line of the car as the first set of brakes and not extending across the center line of the car and the torque tube of the bell crank of the second torque means being sufficiently long so to extend across the center line of the car thus to transfer the brake application force from one side of the car center line to the other.

16. The mechanism of claim 8, wherein the force splitting means comprises a sheave attached to a chain movable by operation of the hand brake, the sheave moving with the chain in a direction generally parallel to the center line of the car.

17. The mechanism of claim 16, wherein the force splitting means further includes a second chain extending through the sheave, one end of the second chain being attached to the first set of brakes and the other end of the second chain being carried by the first lever arm of the bell crank of the first torque means.

18. In a series of interconnected railroad cars wherein adjacent ends of adjoining cars are supported by a common truck having an associated set of wheels and the outer end of each end car in the series is also supported by a truck having a set of wheels, a first set of brakes acting on the set of wheels at the outer end of one of the end cars and a second set of brakes acting on the set of wheels carried by the common truck on which the inner end of the end car is supported, and a manually operable hand brake for producing a brake force applied to the first and second sets of brakes, the improvement comprising: a mechanism for applying the brake force to the first and second set of brakes including force splitting means interconnected with the hand brake and the first set of brakes for transmitting the brake force produced by operation of the hand brake to first set of brakes; first torque means interconnected with the force splitting means for transferring the brake force produced by operation of the hand brake to inner end of the car; and second torque means interconnected with the first torque means and the second set of brakes for transmitting the brake force to the second set of brakes whereby a brake force is applied to the first and second set of brakes sufficient to prevent movement of the series of railroad cars; said first torque means including a bell crank comprising a torque tube extending transversely to the center line of the car; a first lever arm attached to one end of the torque and a second lever arm attached to the other end thereof; the first lever arm being attached to the force splitting means whereby operation of the hand brake produces rotation of the bell crank via the force splitting means.

19. The mechanism of claim 18, wherein the second lever arm of the bell crank is parallel to and in registry with the first lever arm.

20. The mechanism of claim 18, wherein the second torque means includes a bell crank comprising a torque tube extending transversely to the center line of the car, a first lever arm attached to the second set of brakes and a second lever arm interconnected with the second lever arm of the bell crank of the first torque means whereby rotation of the bell crank of the first torque means produces a simultaneous rotation of the bell crank of the second torque means.

21. The mechanism of claim 20, further including a rigid rod one end of which is carried by the second lever arm of the bell crank of the first torque means and the other end of which is carried by the second lever arm of the bell crank of the second torque means.

22. The mechanism of claim 20, wherein the first and second lever arms of the bell crank of the second torque means are parallel to each other with the second lever arm rotated a predetermined angle with respect to the first lever arm.

23. The mechanism of claim 18, wherein the force splitting means comprises a sheave attached to a chain movable by operation of the hand brake, the sheave moving with the chain in a direction generally parallel to the center line of the car.

24. The mechanism of claim 23 wherein the force splitting means further includes a second chain extending through the sheave, one end of the second chain being attached to the first set of brakes and the other end of the second chain being carried by the first lever arm of the bell crank of the first torque means.

* * * * *